United States Patent [19]

Rahn et al.

[11] Patent Number: 5,067,892

[45] Date of Patent: Nov. 26, 1991

[54] EJECTION DEVICE FOR EJECTING A WORKPIECE FROM A DIE IN A FORMING PRESS

[75] Inventors: Oskar Rahn, Göppingen; Günter Riedisser, Eislingen, both of Fed. Rep. of Germany

[73] Assignee: L. Schuler GmbH, Fed. Rep. of Germany

[21] Appl. No.: 432,723

[22] PCT Filed: Feb. 24, 1989

[86] PCT No.: PCT/DE89/00107

§ 371 Date: Jul. 13, 1990

§ 102(e) Date: Jul. 13, 1990

[30] Foreign Application Priority Data

Feb. 24, 1988 [DE] Fed. Rep. of Germany ..... 3806352

[51] Int. Cl.[5] ..... B29C 45/40

[52] U.S. Cl. ..... 425/556; 264/334; 425/436 R; 425/DIG. 5

[58] Field of Search ..... 425/554, 556, DIG. 5, 425/436 R; 264/334, 336

[56] References Cited

U.S. PATENT DOCUMENTS

| | | | |
|---|---|---|---|
| 1,639,840 | 8/1927 | Davis | 264/334 |
| 3,266,071 | 8/1966 | Nebendorf | 72/345 |
| 3,440,860 | 4/1969 | Byam et al. | 72/427 |
| 3,820,376 | 6/1974 | Koch et al. | 72/427 |
| 4,552,525 | 11/1985 | Stehr | 425/556 |

FOREIGN PATENT DOCUMENTS

| | | |
|---|---|---|
| 0151204 | 2/1984 | European Pat. Off. . |
| 1927830 | 2/1972 | Fed. Rep. of Germany . |
| 2106454 | 6/1974 | Fed. Rep. of Germany . |
| 2414442 | 2/1987 | Fed. Rep. of Germany . |
| 472962 | 7/1969 | Switzerland . |

*Primary Examiner*—Timothy Heitbrink

*Attorney, Agent, or Firm*—Evenson, Wands, Edwards, Lenahan & McKeown

[57] ABSTRACT

A device for ejecting a workpiece from a die having a two-armed ejector lever, the drive-side arm of which can be driven by driving rods. The ejector-side arm acts upon an ejector slide. The ejector lever is adjustable for changing the ejector lift. In order to integrate the compensation for different ejection lengths into the ejector lever, the working plane on the drive side and the take-off plane on the ejector side are to be arranged in parallel to the adjustability of the ejector lever. On the other hand, the ejector lever must have a different width in the area between the take-off plane and the bearing which supports the ejector lever during the forming, for projections of different lengths at the workpieces. The width is obtained from the distance of the take-off plane in ejector position of the ejector lever from the bearing minus the length of the ejector lift in this position.

11 Claims, 2 Drawing Sheets

EJECTION DEVICE FOR EJECTING A WORKPIECE FROM A DIE IN A FORMING PRESS

In forming presses, it is required that the ejector slide for ejecting workpieces from dies in a forming press, having a double-armed ejector lever, the drive-side arm of which can be driven be driving rods moved in time with the forming press, the ejector-side arm of which acting upon an ejector slide, for the changing of the ejector lift, the transmission ratio of the ejector lever being changeable by the adjusting of a bearing, and having a bearing supporting the ejector-side arm. The ejector slide is used for ejecting the workpiece that was formed or partially formed in the stage and, during the forming, for counterholding a downwardly extended projection. The ejector movement must be adjusted to the length of such a projection.

A device of this type is known from DE 19 27 830 C2. In this case, the ejector lift can be adjusted by changing the lever conditions at the ejector lever, and a stop, which is fixed at the press, is provided for this ejector lever as the couterstop for the ejector slide during the forming. The ejector lift, which is to be adjusted to projections of different lengths of different workpieces causes a removal plane that differs from one workpiece to the next.

In DE 24 14 442 C2, an ejector device in a forming press was described which has a stop on the press side that can be adjusted to the length of the projection at the workpiece. This type of an adjustment is complicated and expensive. In addition, together with the changing of the ratio of transmission, the removal plane for the workpiece will also shift.

In addition, a forming press is known from EP 0 151 204 A1 which has a pressure cylinder in the power path of the ejector force in order to prevent overloading during a jamming of the ejector.

In contrast, it is an object of the invention to integrate the compensation of different projection lengths of workpieces of different types into the ejector lever In this case, the removal plane (ejector position) that can be reached by the ejector slide must be the same even if the projection lengths differ, while a stop fixed at the press is used as a counterstop during the forming.

This and other objects are achieved by the present invention which provides an arrangement for ejecting workpieces from dies in a forming press comprising an ejector slide and a double armed ejector lever having a drive side arm which is driven by driving rods moved in time with the forming press. This drive side arm forms a drive side working plane. The two armed lever has an ejector side arm which acts upon the ejector slide, the ejector side arm forming an ejector side take off plane. The arrangement also includes a shiftable bearing moveable in a shifting plane and about which the double arm ejector pivots, and adjusting means for changing an ejector lift of the ejection lever, a transmission ratio of the ejector lever being changeable by adjusting a position of the shiftable bearing in the shifting plane, and a support bearing for supporting the ejector side arm. The drive side working plane and the ejector side take off plane extend in parallel with respect to the shifting plane when the ejector lever is moved into an ejector position. For compensating different ejector lifts, the ejector lever, for each transmission ratio, in an area between the take off plane and the support bearing, has a different width, the width being determined as a function of a distance of the take off plane to the bearing minus a length of the ejector lift when the ejector lever is in the ejector position.

The special advantages of the solution result from the constant upper lift position of the ejector slide (removal plane, the lower lift position (forming plane) being variable and adjustable to the projection to be formed on a workpiece by changing the transmission ratio at the ejector lever. The changing of the transmission ratio at the ejector lever—adjustment of the ejector lift—is possible with very low expenditures with respect to manual work and time. The shape of the ejector lever in the area of its contact with the supporting bearing may be defined by a template mold. Reference is made to advantages known per se of roller bearing and swivel joint transmission devices in the power path. The separation of rollers in their assignments to the ejector slide on one side and to the ejector lever on the other side, despite oppositely directed rotational motions, causes a rolling and thus low-friction transition during the forming and ejector movement. As a result of the adjustable bearing of the ejector lever by way of a carriage arrangement, servicing is significantly facilitated. The driving rods for the power take-off from a cam and the introduction of power into the ejector lever permit a tilt-free transfer of the movements while utilizing swivel joints. The ejector system, as a whole, is protected against overloading.

Other advantages are obtained from the representation and description of an embodiment.

BRIEF DESCRIPTION OF THE DRAWINGS

FIG. 2 is a sectional representation corresponding to the course of the section II—II in FIG. 1*a.

DETAILED DESCRIPTION OF THE INVENTION

Figure 1B:
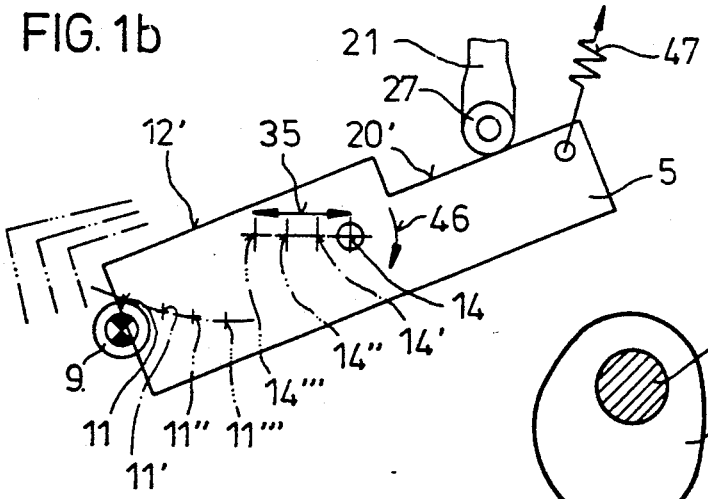
FIG. 1*b* represents the development of a curve for the ejector.

FIG. 1 shows driving, deflecting and ejector devices for the ejecting of a workpiece from a die 3 in the table-side ejector range 1 of the press frame 2 The ejector slide 4 can be actuated by an ejector lever 5 either directly or by way of an ejector rod 6. The ejector lever 5 is disposed in a bearing 14 at a bearing block 13 in a carriage 16. Position numbers 15 refer to required fastening devices between the bearing block 13 and the carriage 16.

Figure 2:
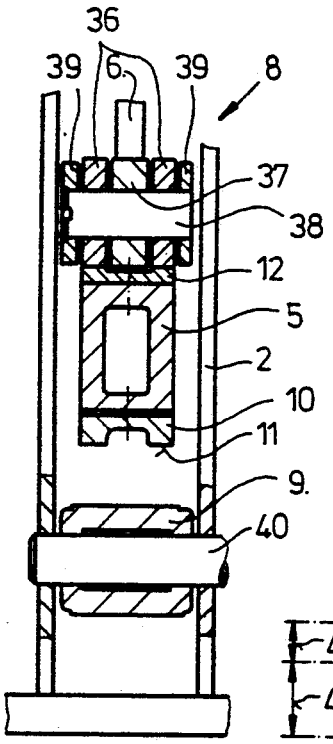

The carriage 16 can be slid in guides 17 by means of a spindle 18 and an adjusting device 19 which turns this spindle 18 in a left-handed and right-handed manner Between the top side—take-off plane 12'—of a hardened pressure plate 12 sunk into the ejector lever 5 and the lower face of the ejector rod 6, a roller arrangement 8 is provided which is disposed at the freely movable end of an intermediate lever 7 at 38. The intermediate lever 7, which is composed, for example, of individual brackets 39, can be swivelled around a point fixed at the frame. The multi-part characteristic of this roller arrangement 8 is shown in detail in the sectional representation in FIG. 2, in which case the same position numbers were used for the same parts. When the ejector lever 5 is moved between the ejector position shown by drawn-out lines —in this case, the ejector slide 4 has reached its uppermost lifting position—and the position shown in dash-dotted lines by reference number 5', in which the ejector lever 5 is supported by a firm stop 9 for the forming, the rollers 36, 37 of the roller arrangement 8 roll in the opposite direction on the lower face of the ejector rod 6 or on the take-off plane 12' of the ejector lever 5.

The fixed stop 9 is constructed as a roller in the point of rotation 40 fixed at the frame. The angle lever 5, by way of driving rods 21, can be acted upon in the sense of an ejector movement The driving rods 21 consist essentially of a parallel guide, such as a straight-line guide for the rollers 29, 27. However, as shown, the rollers 29, 27, by way of pivot bearings 28, 26, may also be pivotably disposed at a crank arm 23 or at a swing arm 25. The crank arm 23 and the swing arm 25 are fixed at the frame in bearings 22 but can be swung. The parallel guide rods 23 and 25 are connected by means of a connecting arm 24 in the pivot bearings 28 and 26. A pressure cylinder 33 is inserted in the connecting arm 24 which, while being acted upon by pressure, holds roller 29 against the cam plate 31 and roller 27 against the top side—working plane 20'—of another hardened pressure plate 20 mounted at the ejector lever 5. For this purpose, the counterforce is generated by an Power accumulator 47, such as an additional pressure cylinder. The cam plate 31 rotates continuously by way of a press-driven shaft 30. Position 32 marks the extension of the piston rod extending out of the pressure cylinder 33.

Figure 1A:
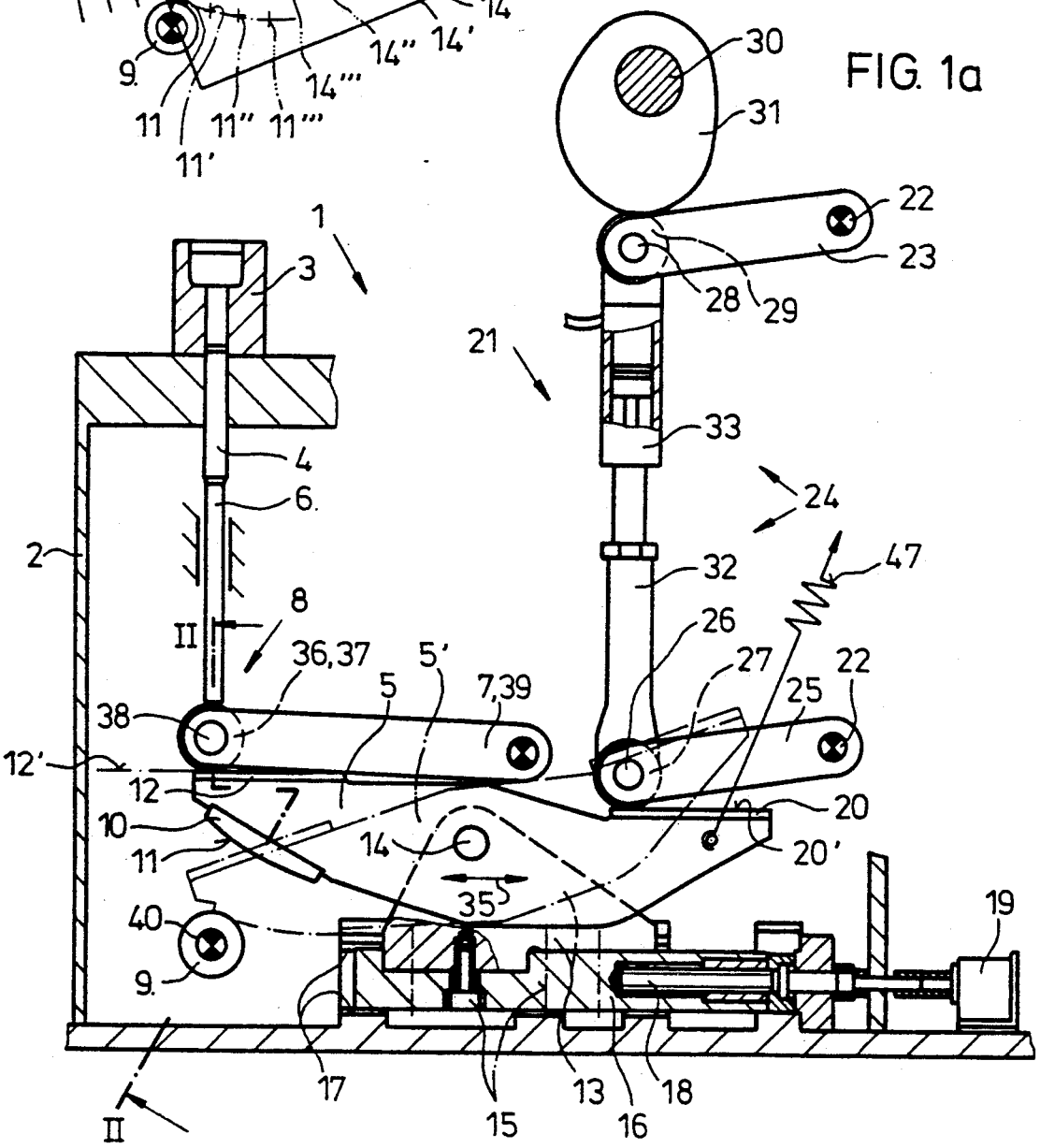
FIG. 1*a* is a view of a cutout of a press in the area of the ejector arrangement for the formed workpiece.

FIG. 1*b* shows the geometric development of a curve 11 at the bottom side of the ejector lever 5 in the area of its contact when the supporting bearing 9. The angle lever 5, which here is replaced by a template which must still be machined, by means of the power accumulator 47, when the working plane 20' is guided against the roller 27 at the driving rods 21. In this case, the driving rods 21 take up the forming position, in which case the cam plate 31 shown in FIG. 1*a* is rotated by 180 angular degrees. When now the template, which characterizes the ejector lever 5, is moved in the direction of arrow 35 from position 14 to positions 14', 14'', 14''', this displacing movement corresponding to the movement of the ejector lever 5 in FIG. 1*a*, while the transmission ratio is changed, a rotation 46 of the template around the bearing 14 is superimposed on this linear movement, as a result of the contact of the template with the roller 27 of the driving rods 21. Overlappings occur in this case with the supporting bearing 9. Points 11, 11', 11'', 11''', which are of interest here, and other intermediate points at the top side of the bearing 9 form the convexly constructed shape 11 to be transmitted to the ejector lever 5. This convex shape 11 may be molded onto a hardened pressure plate 10 which, according to FIG. 1*a*, is fastened to the ejector lever 5. The pertaining positions of the template are indicated by dash-dotted lines.

The ejector lift, which in the following FIGS. 3*a* to 3*d* has the reference number 45, is determined by the length of a projection 44 at a workpiece 43. The workpieces 43, which were added to FIGS. 3*a* to 3*d*, differ with respect to the length of their projections 44. For a better understanding, position number were partially taken over from FIG. 1*a*. These position numbers refer to the same arrangements and parts.

Figure 3A:
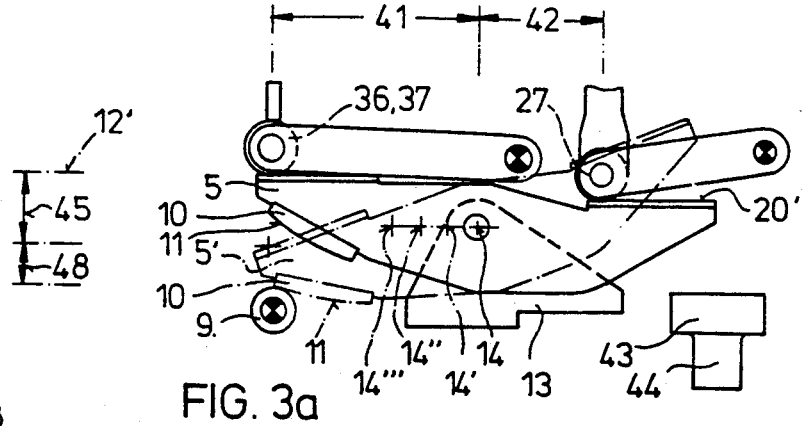
* and FIGS. 3*a* to 3*d* are views of the effects of the changing of the transmission ratio at the ejector lever on the ejector lift and the dimensioning.

FIG. 3*a* shows the ejector position for the ejector lever 5 and the countercontact position 5' of the ejector lever 5 at the supporting bearing 9 for a long projection 44 at the workpiece 43. The pivot bearing 14 of the angle lever 5 is located at the position moved toward the right, so that a shorter distance—drive-side arm 42—is adjusted between the center of the roller 27 or its bearing on the working surface 20' and the center of the pivot bearing 14, and a longer distance—take-off-side arm 41—is adjusted between the center of the pivot bearing 14 and the center of the roller 36 or its bearing on the take-off plane 12'. This causes a larger ejector lift 45 required for the projection 44. Since the angle lever 5 for the forming process is to be prevented from carrying out a more extensive movement in the direction of the press by the supporting bearing 9, the angle lever 5 must have a width for this purpose which has the reference number 48 and is the result of the distance between the top side—take-off plane 12'—of the ejector lever 5 in its ejector position, and the external form of the supporting bearing 9, minus the extent of the ejector lift 45. The development of the width 48 was shown in FIG. 1*b*. In order to be able to eject workpieces 43 with shorter projections 44 from a die 3, the angle lever 5, by means of the adjusting device 19, in FIG. 1*a*, must be moved toward the left, for example, into positions 14', 14'', 14''' or into corresponding intermediate positions.

Figure 3B:
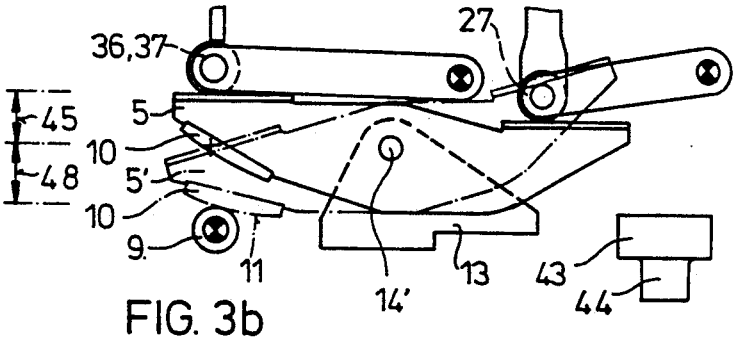
Figure 3C:
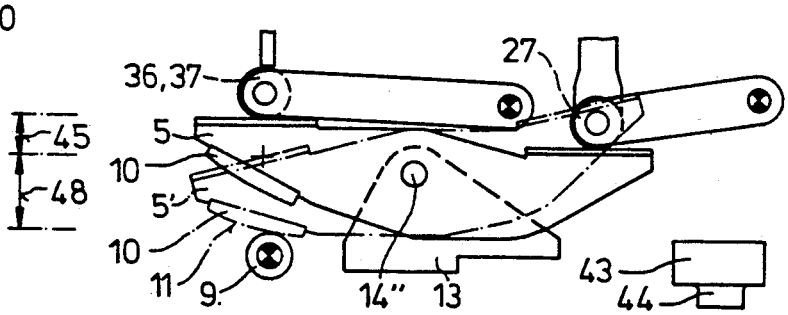
Figure 3D:
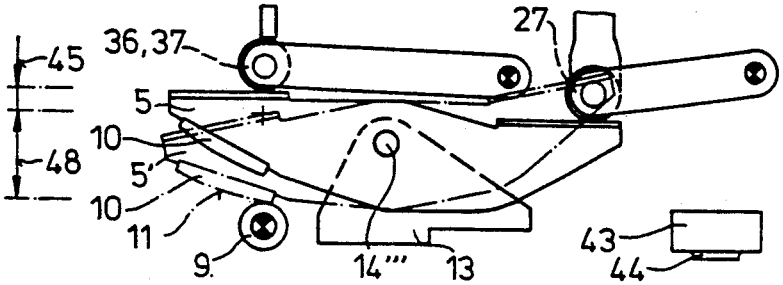

The other FIGS. 3*b* to 3*d* show the necessity of a larger width 48 of the ejector lever 5 in the area between the rollers 36, 37 and the supporting bearings 9 in the case of a shorter projection 44.

Thus, in FIG. 3*d*, the ejector lift 45 is small corresponding to the projection 44 at the workpiece 43. In order to here also support the ejector lever 5 by means of the supporting bearing 9 during the forming process, the ejector lever 5 has a larger width 48 in the area between the rollers 36, 37 and the supporting bearing 9. FIGS. 3*b* and 3*c* show the angle lever 5 in positions 14' and 14'' with the corresponding width 48.

We claim:

1. An ejection device for ejecting a workpiece from a die in a forming press, said ejection device comprising:

an ejector slide;

a double armed ejector lever having a drive side arm which is driven by driving rods moved in time with the formation of the workpiece, said drive side arm forming a drive side working plane, and an ejector side arm which acts upon said ejector slide, said ejector side arm forming an ejector side take off plane;

a shiftable bearing moveable in a shifting plane and about which the double arm ejector pivots;

adjusting means for changing an ejector lift of the ejection lever, a transmission ratio of the ejector lever being changeable by adjusting a position of the shiftable bearing in the shifting plane; and a support bearing for supporting the ejector side arm;

wherein the drive side working plane and the ejector side take off plane extend in parallel with respect to the shifting plane when the ejector lever is moved into an ejector position; and wherein, for compensating different ejector lifts, the ejector lever, for each transmission ratio, in an area between the take off plane and the support bearing, has a different width, the width being determined as a function of a distance of the take off plane to the bearing minus a length of the ejector lift when the ejector lever is in the ejector position.

2. An ejection device according to claim 1, wherein the ejector lever is convexly curved in a contact area with the support bearing.

3. An ejection device according to claim 2, wherein the convex shape of the contact area is determined by a plurality of different contact points between the ejector lever and the support bearing when the ejector lever, with the shiftable bearing, is moved in the shifting plane with a sliding contact of the working plane on the driving rods withdrawn into a forming position.

4. An ejection device according to claim 1, wherein the support bearing is a roller.

5. An ejection device according to claim 1, wherein the support bearing is in alignment with the ejector slide and is fixed to a press frame.

6. An ejection device according to claim 1, further comprising a roller device, said roller device including a one armed intermediate lever which is pivotably disposed in a press frame of the forming press and, at a freely movable end part thereof, has independently rotatable rollers, of which at least one roller is operatively connected with one of a lower front face of the ejector slide and an ejector rod which extends the ejector slide, and of which at least one other roller is operatively connected with the ejector side arm at the take-off plane of the ejector lever.

7. An ejection device according to claim 1, wherein the ejector lever is disposed in a pivot bearing of a bearing block which is disposed in a carriage movable in guides and adjusted by the adjusting means.

8. An ejection device according to claim 1, wherein the driving rods include parallel rods with an equally long crank arm and swing arm, and wherein a power flux takes place between the introduction of power by a press drive and the guiding of power onto the angle lever for an ejection movement in a longitudinal course of a connecting arm.

9. An ejection device according to claim 8, wherein the introduction of power onto the connecting arm and the application of power onto the angle lever takes place by means of a crank arm roller, and a swing arm roller which are pivotably arranged, respectively, at end areas of the crank arm and the swing arm.

10. An ejection device according to claim 9, wherein a pressure cylinder is inserted into the connecting arm and, when the pressure cylinder is acted upon by pressure, the crank shaft roller is pressed against a press driven cam plate, and the swing arm roller is pressed against the drive side arm of the angle lever.

11. An ejection device for ejecting a workpiece from a die in a forming press, said ejection device comprising:

an ejector slide; and a double armed ejector lever having a drive side arm which is driven by driving rods moved in time with the formation of the workpiece, said drive side arm forming a drive side working plane, and an ejector side arm which acts upon said ejector slide, said ejector side arm forming an ejector side take off plane, said double armed ejector lever including means for adjusting an ejector lift of the ejection lever to compensate for different ejection lengths such that the ejector side take off plane always extends in parallel with respect to the shifting plane when the ejector lever is moved into an ejector position.

* * * * *